US005118030A

United States Patent [19]

McNamara et al.

[11] Patent Number: 5,118,030

[45] Date of Patent: Jun. 2, 1992

[54] MAILER WITH PERFORATED ADHESIVE AREAS

[75] Inventors: John D. McNamara, Leeds; Cyril G. Lazarus, Northamptonshire, both of England

[73] Assignee: Moore Business Forms, Inc., Grand Island, N.Y.

[21] Appl. No.: 448,122

[22] Filed: Dec. 11, 1989

[30] Foreign Application Priority Data

Mar. 30, 1989 [GB] United Kingdom ..... 8907150

[51] Int. Cl.[5] ..... B65D 27/10; B65D 27/06

[52] U.S. Cl. ..... 229/69; 229/305; 462/6; 462/64

[58] Field of Search ..... 229/73, 69; 282/11.5 R, 282/11.5 A, 25; 462/6, 64

[56] References Cited

U.S. PATENT DOCUMENTS

| | | | |
|---|---|---|---|
| 3,184,150 | 5/1965 | Hubbard | 229/73 |
| 3,437,259 | 4/1969 | Steidinger | 229/73 |
| 3,554,438 | 1/1971 | Van Malderghem | 229/73 |
| 4,055,294 | 10/1977 | Traise | 229/73 |
| 4,645,123 | 2/1987 | Ashby | 229/69 |
| 4,669,652 | 6/1987 | Seguin | 229/73 |
| 4,705,298 | 11/1987 | Van Malderghem et al. | 229/73 |

FOREIGN PATENT DOCUMENTS

| | | | |
|---|---|---|---|
| 143622 | 6/1985 | European Pat. Off. . | |
| 838558 | 6/1960 | United Kingdom | 229/69 |
| 1237659 | 6/1969 | United Kingdom . | |
| 1416409 | 12/1975 | United Kingdom . | |
| 1491916 | 11/1977 | United Kingdom . | |
| 1567928 | 5/1980 | United Kingdom . | |
| 1585342 | 2/1981 | United Kingdom . | |

*Primary Examiner*—Stephen P. Garbe
*Attorney, Agent, or Firm*—Nixon & Vanderhye

[57] ABSTRACT

A continuous mailer type business form includes a top ply, a single or multiple part insert ply, and a return envelope. The return envelope comprises first and second plies secured along three edges, with a fourth edge open, and one of the first and second plies is adapted to be folded over the open edge to close it. The second ply comprises marginal areas of adhesive adjacent at least one edge with tear off perforations disposed within the marginal areas of adhesive. The marginal areas of adhesive connect the first and second plies on one side of the perforations, and the second and top plies on the opposite side of the perforations. The insert and first plies are unconnected to the top ply by the marginal areas of adhesive. The marginal areas of adhesive may comprise longitudinally spaced diagonal strips, with the width of the marginal areas of adhesive approximately the same on the opposite sides of the perforations. Preferably the marginal areas are provided along two opposite edges of the return envelope, while a continuous strip of adhesive secures the first and second plies together along the edge opposite the open edge of the return envelope.

18 Claims, 2 Drawing Sheets

MAILER WITH PERFORATED ADHESIVE AREAS

BACKGROUND AND SUMMARY OF THE INVENTION

This invention relates to return business forms assemblies, or "mailers", and has particular reference to return continuous business forms assemblies comprising a continuous web assembly made up of a plurality of interleaved continuous webs secured together and capable of receiving data applied thereto as by a typewriter or print unit. The mailer includes a sheet embodying transfer material to enable data applied to the top web to be duplicated (and sometimes selectively duplicated) on an underlying web or webs. An exemplary business forms assembly of the general type of the invention is described in British patent specification no. 1237659. Such assemblies have also included a composite web which constituted a return envelope web. Such an assembly is shown in FIGS. 8 to 16 of British patent specification no. 1237659. It is also known to provide a continuous business forms assembly embodying two or more continuous webs one of which has marginal areas of adhesive with tear off lines of perforations within the areas of adhesive to enable the marginal areas of adhesive to be detached by tearing along the lines of perforations by the eventual customer Such an assembly is described in European patent specification no. 143622.

According to the present invention, an improved construction of return continuous business forms assembly, or mailer, is provided.

The mailer according to the present invention includes an improved return envelope and a part capable of being able to readily receive typewritten or handwritten information and capable of being inserted into the return envelope part where it can be returned to the initial sender and the information processed by such initial sender.

According to one aspect of the present invention a return continuous envelope business forms assembly comprises a plurality of webs (secured together) of which the first part is able to receive data applied to it as by a typewriter or print unit, and an underpart (insert) comprises a part to receive information supplied by a customer and a further part comprises a composite web (return envelope) and wherein the composite web comprises two plies one of which bears marginal areas of. adhesive and the assembly having lines of tear off perforations within the marginal areas of adhesive to enable the marginal areas of adhesive to be removed and the underpart of the assembly processed by the customer.

Preferably the first part of the assembly bears transfer material to enable information applied to the first part to be reproduced on at least one of the underlying parts. Conveniently the transfer material is arranged to enable the information to be selectively applied to the underlying parts.

The composite web may comprise one ply with areas of adhesive arranged on three sides of the ply with lines of perforations within the areas of adhesive and the fourth side bears processable adhesive (for example adhesive covered by a barrier coating) provided on a flap part of the composite webs to enable the composite web part to be sealed.

According to another aspect of the present invention a return envelope business forms assembly comprises a plurality of webs and wherein one of the webs bears adhesive in an adhesive pattern comprising a plurality of areas of adhesive in lines with the lines of areas divided into two separate parts by a gap with one separate part of adhesive being contacted by one ply of the plurality of webs and the other separate part of adhesive being contacted by another ply of the plurality of webs.

DETAILED DESCRIPTION OF THE DRAWINGS

Figure 1:
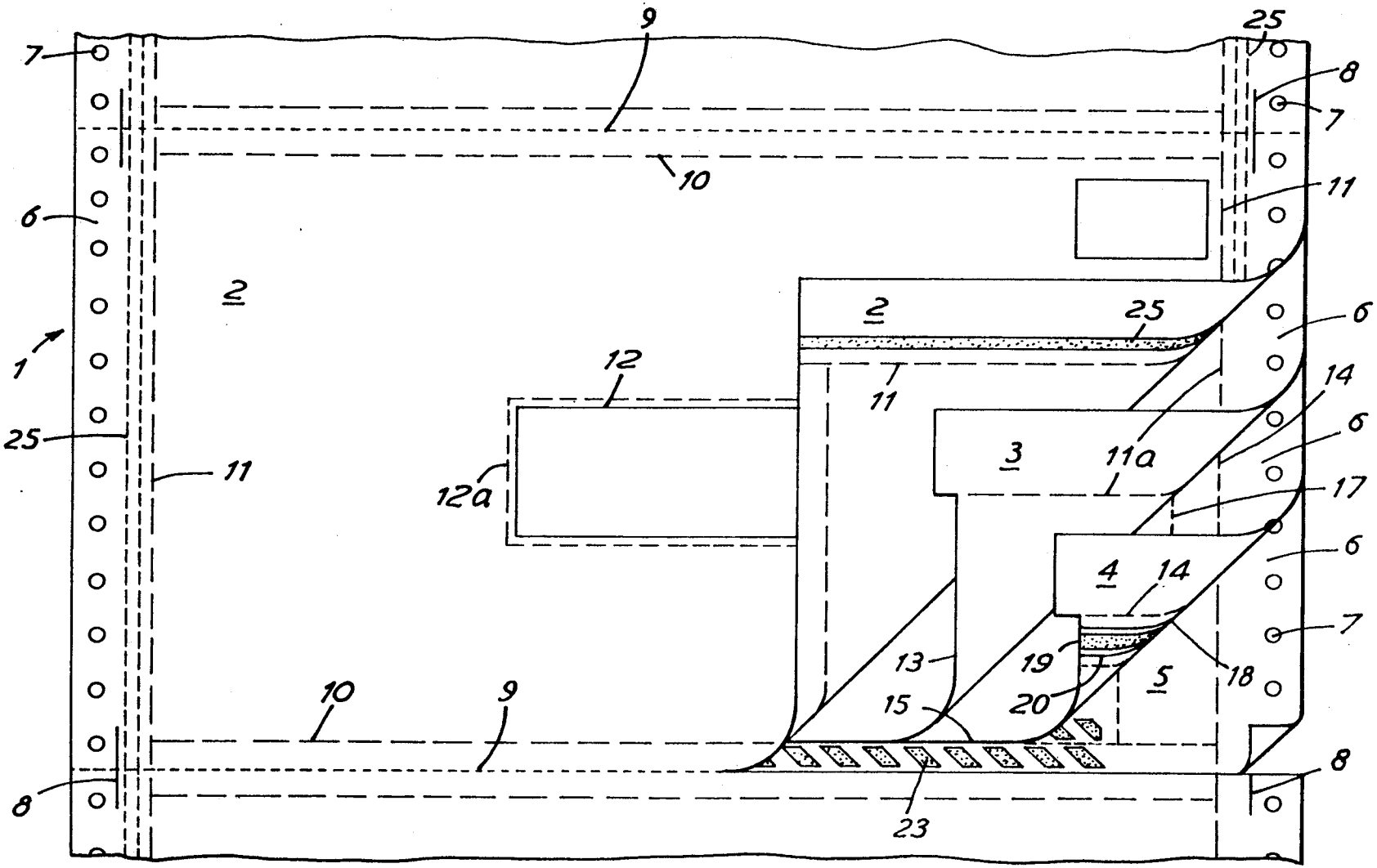
FIG. 1 is a view of a length of an exemplary assembly according to the invention, with plies of the assembly folded back to reveal the plies underneath.

The drawings illustrate a return continuous business forms assembly (mailer) 1 comprising a plurality of plies (as shown four plies 2, 3, 4, and 5). Each of the plies comprises a web with longitudinal margin 6 at opposite sides of the web. Each margin contains feed apertures 7 arranged in line to facilitate feeding of the assembly 1 through a print unit or the like to have variable information or data applied thereto. These margins may be detached from the remainder of the assembly by passing the assembly through a slitter mechanism which slits the assembly 1 along the line illustrated by the lines 8 on FIG. 1 of the drawing. Each of the plies 2, 3, 4 and 5 of the assembly is provided with lines of transverse perforations 9 to divide each of the plies into form lengths.

The quadrate top ply 2 of the assembly has lines of transverse perforations 10 and lines of longitudinal perforations 11 to enable the side and end marginal edges of the form length of the assembly to be detached after the margins defined by the lines 8 have been removed The lines 10 are adjacent to and on opposite sides of the line of transverse perforations 9 and the longitudinal lines of perforation 11 are between the slitter lines 8 and the body of the form length. Lines of adhesive 25 on the rear face of the ply 2 are provided at the sides of the top ply 2 outside the perforation lines 11 to secure the front ply to underlying plies.

An address position 12 is provided on each form length of the top ply 2 to enable an address, or other variable information, to be printed on the form length as by a line printer. If appropriate, the rear of the address position 12 on each form length of the ply 2 is provided with transfer material **12*a* (e.g. carbon spot, or microcapsules) to enable an address printed on the ply 2 to be reproduced on underlying plies. However, for some applications the transfer material 12*a* is not required. The quadrate insert ply 3 is likewise divided into form lengths by the transverse perforation lines 9 and has a line of longitudinal perforations 11*a* at each of the opposite sides of the insert ply 3. These longitudinal lines of perforations 11*a* are in register with lines of perforation 11 on the top ply 2**.

The insert ply 3 bears a series of die cuts 13. These die cuts 13 extend between the trailing end of one form length of the ply 3 and the leading edge of the next adjacent form length of the ply 3. The position of the sides of these die cuts is arranged to underlie and be in register with the transverse perforations 10 on the top ply 2. The die cuts 13 do not extend into the longitudinal margins 6. Each form length of the ply 3 is intended to be sent to a customer to have the customer insert on this form length of the ply 3 any information that is asked for. For example if the assembly is to be used as a questionnaire this form length of the ply 3 constitutes a questionnaire which a customer or other party will be asked to complete before returning to the sender. It will be apparent that if required additional insert plies corresponding to the ply 3 may be included in the mailer 1 to suit particular requirements in which case the ply 3 is provided in duplicate, triplicate or in more parts as may be required.

The next part of the assembly which is to form a part of a composite envelope (to be hereinafter described) comprises a quadrate ply 4 which also has longitudinal lines of perforations 14 adjacent one edge of the ply 4 and in register with the longitudinal lines of perforations 11 in the ply 2 and the lines of perforations 11*a* in the ply 3. The ply 4 is provided with a series of die cuts 15 and these die cuts are arranged to overlie and to be in register with the die cuts 13 in the insert ply 3. The die cuts 15 are arranged at the leading edge and trailing edge of the form length.

Adjacent one of the longitudinal lines of perforations 14 a line of adhesive 16 extends from the leading edge of the form length to the trailing edge of the form length. This line of adhesive 16 is provided on the rear face of the form length. A fold line 17 is provided on the opposite side of the form length to the line of adhesive 16. This fold may be in form of a line of perforations to facilitate easy folding over of the flap 18 which is constituted by the outer marginal part of the form length beyond the fold line 17. This flap 18 is provided on its rear side with a clean stick adhesive strip 19. The strip 19 preferably comprises a double sided adhesive tape secured to the rear side of the flap and the adhesive strip 19 is covered by a barrier strip 20. Alternatively some other form of adhesive, for example remoistenable adhesive, may be used. The part 4 bears a return address portion so that the envelope may be returned to the original sender.

The next part 5 of the assembly which forms the other part—with ply 4—of a quadrate composite return envelope, has a line of longitudinal perforations 21 at each side of the ply 5 in register with the lines of perforation 11, 11*a*, and 16 in the other plies and has in addition to the transverse lines of perforation 9 a further set of transverse perforations 22 on opposite sides of the transverse line of perforations 9 in each of the form lengths. Areas of pattern pasted adhesive 23 are provided on opposite sides of each of the transverse lines of perforations 22. Preferably the lines of pattern pasted adhesive 23 are in the form of longitudinally spaced diagonal lines of adhesive extending on opposite sides of the lines of perforations 22 but having a broken space or gap between the lines of adhesive adjacent the lines of tear-off perforations 22. Thus there is a gap in the adhesive pattern so that one part 23*a* of the adhesive secures the ply 5 to the ply 4 and the other part 23*b* of the adhesive secures the ply 5 to the ply 2 through the die cuts of the intermediate plies 3, 4, but because of the gap, the plies, 2, 4, are not directly secured together by adhesive. The parts 23*a*, 23*b* have approximately the same width.

Figure 2:
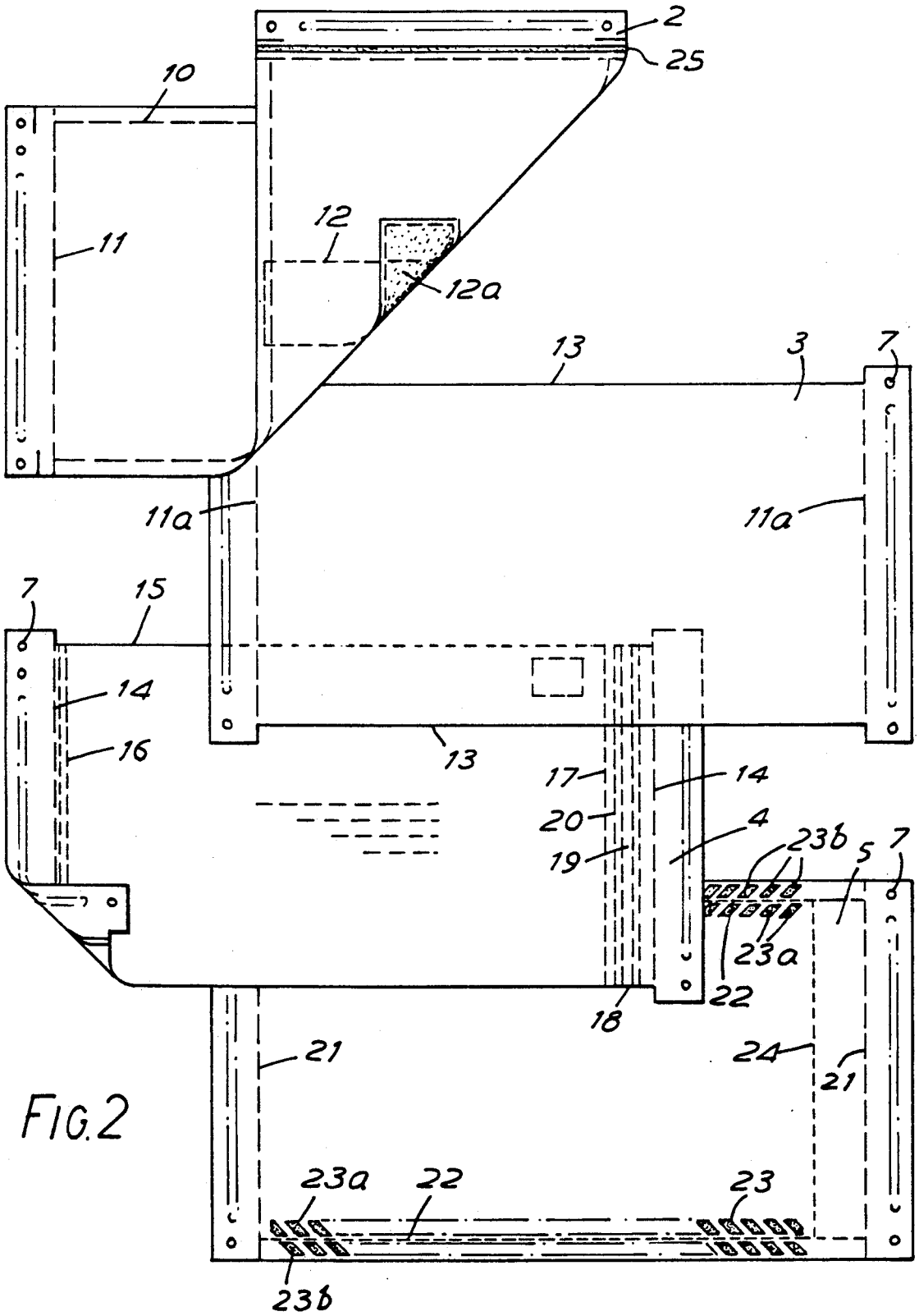
FIG. 2 is a part exploded view of the assembly showing one form length of each of the plies of the assembly.

An additional longitudinal line of perforations 24 is provided adjacent one of the lines of longitudinal perforations 21 as shown on the right hand side of the form length as shown in FIG. 2. This line of perforations 24 extends only between the transverse lines of perforations 22 in each form length and is provided to enable the part of the form length to be detached for further processing as will be described hereinafter.

It is intended that the form lengths of the plies 4 and 5 shall form a composite return envelope ply and for this reason the inner lines 23*a* of pattern pasted adhesive 23 serve to join the ply 4 to the ply 5 at the bottom edge. The plies 4 and 5 are also secured together at the side edges by the line of adhesive 16 on the rear face of the ply 4. By these lines of adhesive 23 and 16 the envelope part will be secured on three sides and left open on the fourth side (top). The rear ply 5 is also secured to the first play 2 by the adhesive 23*b*.

The mailer 1 according to the invention is used to dispatch to a customer or the like data (such as a questionnaire), and is processed in a line printer to have the name and address of the customer, or like variable data, to be provided on the address position 12 on the front of the top ply 2. If required the rear face of the top ply 2 of the assembly bears transfer material (e.g. a carbon spot) to enable the address to which the questionnaire is addressed to be recorded on an underlying copying beneath the top ply 2.

The return business forms assembly I is then divided into form lengths by detaching along the line of transverse perforation 9, e.g. by a burster or detacher mechanism, and the single part of the assembly is dispatched to the customer.

On receipt by the customer the questionnaire is opened by detaching the marginal part of the form length by first folding along the perforation line 10, as by folding along the perforation line at the leading end of the form length of the assembly, and then tearing off along the line of transverse perforations 10. This is repeated by folding and tearing along the other line of transverse perforations 10 of the form length and subsequently by folding and tearing along the two longitudinal lines of perforations 11. The top ply 2 of the assembly 1 is then discarded and the information recorded on the insert ply 3.

The flap on the first envelope ply 4 is then folded over by folding about the longitudinal line of perforations 17 to reveal the line of clean stick adhesive 19 covered by the barrier coating 20. The questionnaire part (insert ply) 3 is then inserted into the envelope part formed by the composite of the plies 4 and 5. The barrier coating 20 is then removed from the adhesive 19 and the flap on the part 5 of the assembly is folded about the perforation line 24 into contact with the revealed line of adhesive 19.

The envelope (4, 5) containing the questionnaire (3) is then returned to the original sender and the questionnaire is removed from the composite envelope and processed.

It will be apparent that the mailer described is suitable for use by many institutions sending out questionnaires for example by National Authorities who receive requests from the public for grants, etc., and the questionnaire is drafted to secure answers to questions which may decide whether the person completing the questionnaire is entitled for a grant or not. It may also be used for other purposes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A continuous mailer type business form comprising:

a top ply adapted to receive variable information thereon;

an insert ply adapted to receive variable information applied by the recipient of the mailer;

a quadrate return envelope comprising first and second plies secured together along three edges, with a fourth edge open, one of said first and second plies adapted to be folded over the open edge to close it; and said second ply comprising marginal areas of adhesive adjacent at least one edge thereof with tear off perforations disposed within said marginal areas of adhesive, said adhesive connecting said first and second plies together on one side of said perforations, and said second and top plies together on the opposite side of said perforations, said insert and first plies unconnected by said marginal areas of adhesive to said top ply.

2. A business form as recited in claim 1 wherein said second ply comprises the bottom ply of the business form.

3. A business form as recited in claim 1 wherein said marginal areas of adhesive comprise longitudinally spaced diagonal bands of adhesive.

4. A business form as recited in claim 3 wherein the areas of adhesive on opposite sides of said tear off perforations have approximately the same width.

5. A business form as recited in claim 4 further comprising transfer material provided on the bottom surface of the top ply to transfer variable data placed thereon to the insert ply.

6. A business form as recited in claim 5 wherein said transfer material is applied to only a small portion of the top ply.

7. A business form as recited in claim 4 wherein the edge of said return envelope opposite said open edge includes a continuous strip of adhesive with no perforations therewithin, and wherein the other two edges of said envelope are defined by said marginal areas with tear off perforations disposed therewithin.

8. A business form as recited in claim 7 wherein said insert ply has die cut areas at two edges thereof to facilitate securement of said top ply to said second ply with said insert ply therebetween, and without said insert ply being secured by adhesive directly to said top or second plies.

9. A business form as recited in claim 1 wherein the areas of adhesive on opposite sides of said tear off perforations have approximately the same width.

10. A business form as recited in claim 1 further comprising transfer material provided on the bottom surface of the top ply to transfer variable data placed thereon to the insert ply.

11. A business form as recited in claim 10 wherein said transfer material is applied to only a small portion of the top ply.

12. A business form as recited in claim 1 wherein the edge of said return envelope opposite said open edge includes a continuous strip of adhesive with no perforations therewithin, and wherein the other two edges of said envelope are defined by said marginal areas with tear off perforations disposed therewithin.

13. A business form as recited in claim 12 wherein said insert ply has die cut areas at two edges thereof to facilitate securement of said top ply to said second ply with said insert ply therebetween, and without said insert ply being secured by adhesive directly to said top or second plies.

14. A business form as recited in claim 12 said marginal areas of adhesive comprise longitudinally spaced diagonal bands of adhesive.

15. A multi-ply business form including first, second, and third plies, said second ply having an adhesive strip with perforations parallel to and disposed within the strip, the adhesive on one side of the perforation securing said second ply to said first ply, and the adhesive on the opposite side of said perforations securing said second ply to said third ply.

16. A business form as recited in claim 15 wherein said business form comprises a mailer and said first and second plies comprise a return envelope and said third ply comprises a top ply of the mailer.

17. A business form as recited in claim 15 wherein said marginal areas of adhesive comprise longitudinally spaced diagonal bands of adhesive.

18. A business form as recited in claim 17 wherein the areas of adhesive on opposite sides of said perforations have approximately the same width.

* * * * *